US011313209B2

(12) United States Patent
Hill et al.

(10) Patent No.: US 11,313,209 B2
(45) Date of Patent: Apr. 26, 2022

(54) SELF-ORIENTING GAS EVADING INTAKE FOR SUBMERSIBLE PUMPS

(71) Applicant: Halliburton Energy Services, Inc., Houston, TX (US)

(72) Inventors: Jason Eugene Hill, Catoosa, OK (US); Donn J. Brown, Broken Arrow, OK (US); Joshua Wayne Webster, Owasso, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 490 days.

(21) Appl. No.: 16/463,296

(22) PCT Filed: Feb. 23, 2018

(86) PCT No.: PCT/US2018/019404

§ 371 (c)(1),
(2) Date: May 22, 2019

(87) PCT Pub. No.: WO2019/164505

PCT Pub. Date: Aug. 29, 2019

(65) Prior Publication Data

US 2020/0308940 A1 Oct. 1, 2020

(51) Int. Cl.
*E21B 43/12* (2006.01)
*F04D 13/10* (2006.01)
(Continued)

(52) U.S. Cl.
CPC ..... *E21B 43/128* (2013.01); *E21B 34/14* (2013.01); *E21B 43/121* (2013.01); *F04D 9/006* (2013.01);
(Continued)

(58) Field of Classification Search
CPC ..... E21B 43/128; E21B 43/38; E21B 34/14; E21B 43/121; F04D 13/10; F04D 29/708; F04D 9/003; F04D 9/006
See application file for complete search history.

(56) References Cited

U.S. PATENT DOCUMENTS 6,257,333 B1 7/2001 Mann et al.
7,980,314 B2 * 7/2011 Mack ..... E21B 34/06 166/369
(Continued)

FOREIGN PATENT DOCUMENTS

WO 2010/118351 A1 10/2010

OTHER PUBLICATIONS

International Search Report and Written Opinion issued in related PCT Application No. PCT/US2018/019404 dated Nov. 19, 2018, 15 pages.
(Continued)

*Primary Examiner* — Peter J Bertheaud
(74) *Attorney, Agent, or Firm* — Conley Rose, P.C.; Rodney B. Carroll

(57) ABSTRACT

A self-orienting gas evading intake for a submersible pump provides an efficient, reliable and inexpensive system for pumping a downhole fluid to a surface. An intake section of a submersible pumping system may comprise a blocker sleeve disposed between an external housing and an eccentric intake. The intake section may be self-orienting such that a gas component of the fluid ascends the borehole to separate from a liquid component of the fluid. Actuation of a blocker sleeve exposes one or more ports of the external housing while blocking one or more other ports. The liquid component is drawn into the intake section through an exposed port and through one or more openings of the eccentric intake. The liquid component may then be drawn into the pump. As the liquid component comprises non-
(Continued)

detrimental amounts, if any, of a gas component, the pump operates efficiently and effectively.

19 Claims, 6 Drawing Sheets

(51) Int. Cl.
*F04D 29/70* (2006.01)
*E21B 34/14* (2006.01)
*F04D 9/00* (2006.01)

(52) U.S. Cl.
CPC ..... *F04D 13/10* (2013.01); *F04D 29/708* (2013.01); *F05B 2260/64* (2013.01)

(56) References Cited

U.S. PATENT DOCUMENTS

| | | | | |
|---|---|---|---|---|
| 9,494,022 | B2 * | 11/2016 | Coates | E21B 43/128 |
| 2010/0096140 | A1 | 4/2010 | Mack | |
| 2014/0369868 | A1 | 12/2014 | Tetzlaff et al. | |
| 2015/0204169 | A1 | 7/2015 | Coates et al. | |

OTHER PUBLICATIONS

International Preliminary Report on Patentability issued in related PCT Application No. PCT/US2018/019404 dated Sep. 3, 2020, 12 pages.

* cited by examiner

SELF-ORIENTING GAS EVADING INTAKE FOR SUBMERSIBLE PUMPS

CROSS-REFERENCE TO RELATED APPLICATION

The present application is a U.S. National Stage Application of International Application No. PCT/US2018/019404 filed Feb. 23, 2018, which is incorporated herein by reference in its entirety for all purposes.

TECHNICAL FIELD

The present disclosure relates generally to well drilling and hydrocarbon recovery operations and, more particularly, to systems and methods for gas avoidance systems of a submersible pump such as a self-orienting gas evading intake.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve several different steps such as, for example, drilling a wellbore at a desired well site, treating the wellbore to optimize production of hydrocarbons, and performing the necessary steps to produce and process the hydrocarbons from the subterranean formation.

When producing and processing the hydrocarbons from the subterranean formation, an underground pump is often used to force fluids toward the surface. More specifically, a submersible pump, for example, an electrical submersible pump (ESP), may be installed in a lower portion of the wellbore and used to pressurize fluids, thereby sending the fluids toward the surface. Submersible pumps are used to lift such fluids from a borehole drilled to contact a downhole reservoir. Entrapped within the fluid of the downhole reservoir may be pockets of gas. Generally, a submersible pump does not operate or does not function efficiently when exposed to gas. Gas avoidance systems may be used to thwart or minimize the exposure or intake of the submersible pump to such pockets of gas. The orientation and location of the borehole may not be known or may not be known with a degree of certainty or accuracy causing exposure of the submersible pump to a gas pocket. Currently downhole gas separators typically centrifugally separate the heavier fluid (such as oil) from the lighter fluid (such as gas pockets) to minimize the exposure of the submersible pump to gas pockets or to minimize the size of the gas pockets. Current downhole gas separators may also use inverting shrouds to divert the gas and liquid through a trajectory where the gas naturally collects at a distal end from the intake of the submersible pump. However, these systems may not operate in smaller diameter boreholes, may be expensive, may require specialized equipment or complex equipment, may require experience personnel or any combination thereof. Systems and methods that provide gas avoidance for an intake of a submersible pump are needed that provide an efficient, reliable and inexpensive operation of submersible pump downhole for any type of borehole or hydrocarbon recovery operation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

The hydrocarbon recovery and production industry utilize submersible pumps to lift fluid from a borehole in fluid communication with a downhole reservoir. Gas pockets may be entrapped within the fluid of the downhole reservoir. Generally, gas pockets adversely affect the operation of the submersible pumps used to produce the fluid. Currently, gas avoidance systems may be used for mostly or substantially vertical or mostly or substantially horizontal boreholes. In reality, the actual landing angle and orientation of the submersible pump system may not be known or may be inaccurate. Such inaccuracies may allow gas pockets to be drawn into the intake of the submersible pump causing the submersible pump to cease functioning or preventing efficient operation of the submersible pump. For example, a borehole may have one or more undulations or peaks or valleys that trap gas pockets such that if a submersible pump lands in such an area the submersible pump may intake a harmful, destructive or undesirable amount of gas. The intake of gas by the submersible pump may cause delays in the hydrocarbon operation while an operator ceases operation of equipment to allow the production tubing to drain to separate the gas pocket or components of the fluid from the liquid components of the fluid. Such delays increase the expense of the hydrocarbon operation. Current submersible pumps may be expensive with complex components which may require extensive training to operate.

A submersible pump, such as an electrical submersible pump, according to one or more embodiments, may provide a simple, efficient, easy to implement and reliable pumping system for production of a fluid from a borehole in fluid communication with a reservoir in a formation. A blocker sleeve of an eccentric intake tube that freely slides about an interior of an intake section of a pumping system and self-orients due to gravity may provide an input for flow of fluid to a pump of the pumping system without allowing harmful amounts of gas to be drawn into the intake section of the pumping system.

Figure 1:
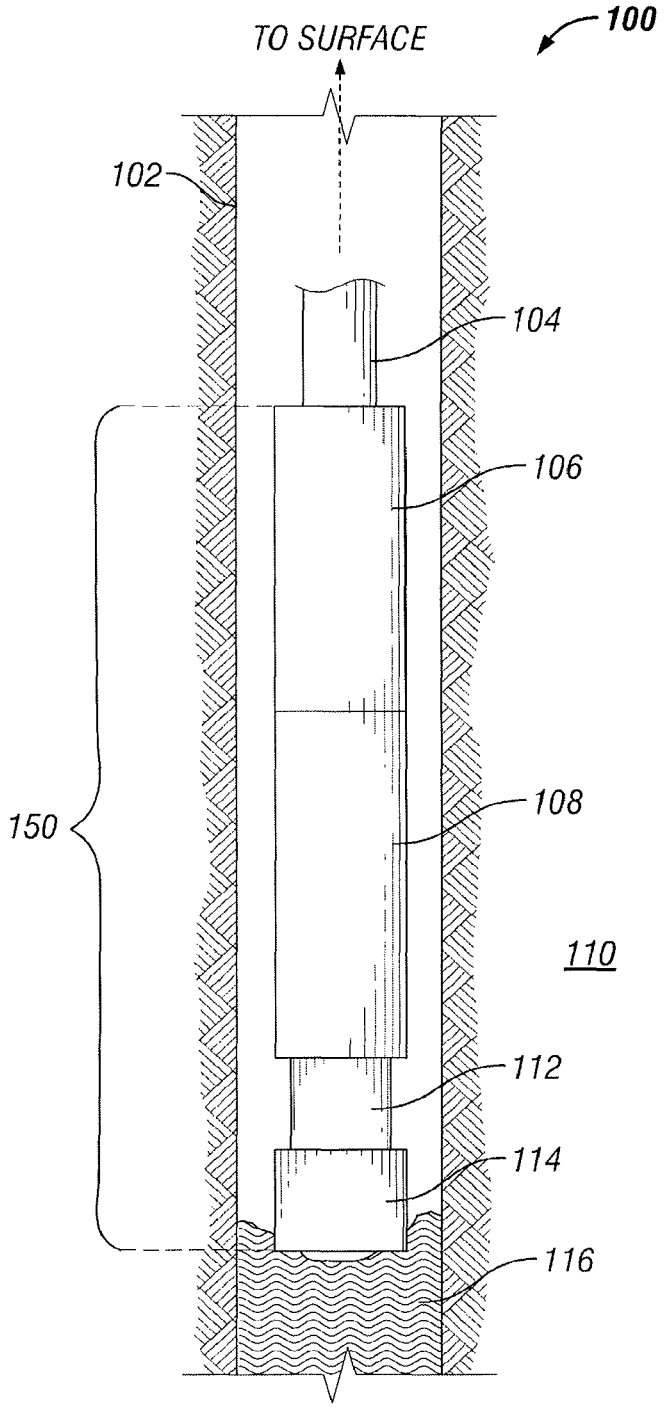
FIG. 1 is a schematic of a pumping system in a wellbore environment, according to one or more aspects of the present disclosure.

Turning now to the drawings, FIG. 1 illustrates a schematic cross-sectional view of a pumping system 150 for a wellbore environment 100, in accordance with one or more aspects of the present disclosure. The pumping system 150 may be disposed within a wellbore or borehole 102, which may be cased or uncased according to a particular implementation, in a formation 110. The pumping system 150 may comprise a pump 106, such as a centrifugal pump or any other electrical submersible pump (ESP), coupled to a gas avoidance system (such as an intake section 108), a seal section 112, and a motor section 114. In general, the pumping system 150 may be suspended by a tubing or pipe 104 (including, but not limited to, a production tubing or a coiled tubing) of a borehole 102 in a suitable manner known in the art, with a submersible electrical cable extending from a power supply on the surface (not shown) to the motor of the motor section 114. The pump 106 may comprise one or more intakes (not shown) proximate to the intake section 108. The pump 106 may have a pump outlet (not shown) located and attached for flow to a conduit for receiving pumped fluid, for example, fluid 116, in the vicinity of an upper end of the pump 106. As, during or after the pumping system 150 is disposed in borehole 102, the fluid level of fluid 116 may be above the intake section 108 which provides sufficient intake pressure to allow for fluid 116 or any other fluid to be pumped to the surface or any other location. From this upper end, the pump 106 may be connected to a conduit (not shown) for carrying the fluid 116 to the surface or into the casing of another submersible pump.

Figure 2:
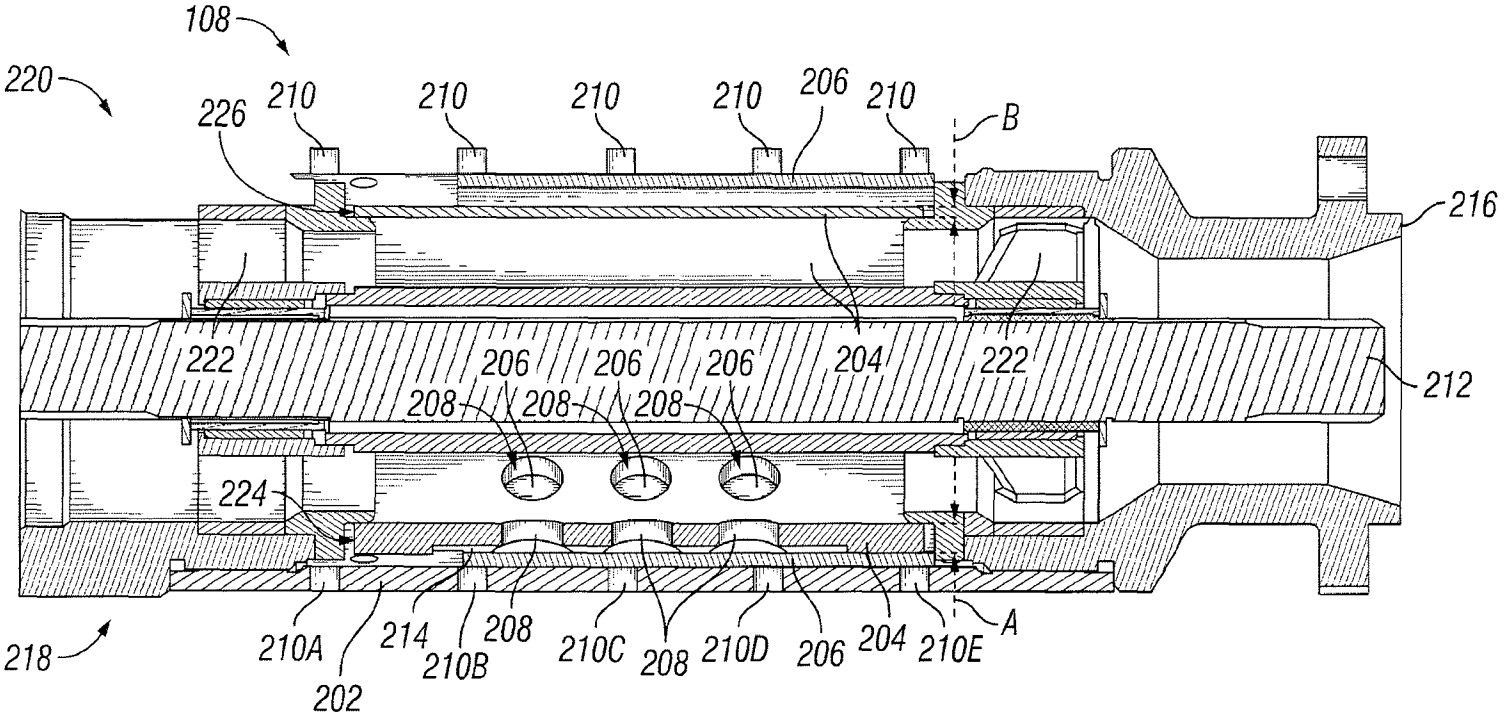
FIG. 2 is a schematic cross-sectional view of an intake section of a pumping system, according to one or more aspects of the present disclosure.

FIG. 2 is a is a schematic cross-sectional view of an intake section 108 of pumping system 150, according to one or more aspects of the present disclosure. Intake section 108 may comprise an external housing 202, an end cap 216, a flow path 214, a drive shaft 212, a blocker sleeve 206, an eccentric intake 204 and one or more bearing supports 222. External housing 202 may circumvent or be disposed about substantially or completely any one or more components of the intake section 108. External housing 202 may comprise carbon steel or any other suitable material. External housing 202 may comprise one or more ports 210, for example, ports 210A, 210B, 210C, 210D and 210E. In one or more embodiments, the external housing 202 may comprise any number of ports 210 spaced about the external housing 202, for example, axially along, circumferentially about or both the external housing 202. In one or more embodiments, external housing 202 may comprise a first set of one or more ports 210 on a top portion or side 220 of the external housing 202 and a second set of one or more ports 210 on a bottom portion or side 218 of the external housing 202. The top side 220 is closer to a surface or oriented away from a fluid (such as fluid 116 of FIG. 1) while the bottom side 218 is further from the surface or oriented towards a fluid 116. The one or more ports 210 provide or allow for a fluid communication between the borehole 102 to a flow path 214. Flow path 214 may comprise a groove, aperture, enclosure, tubing, other pathway or any combination thereof that permits fluid, for example, fluid 116, or any component thereof to flow through or around any one or more portions of the intake section 108. The one or more ports 210 may be of any size, shape or dimension. The number, size, shape, dimension or any other property of the one or more ports 210 may be based, at least in part, on any one or more characteristics of a fluid including, but not limited to, the viscosity, density or type of formation or production fluid to be pumped, for example, fluid 116, type, size, orientation or any other dimension of borehole 102, one or more characteristics associated with a pump 106, one or more characteristics associated with a motor section 114 or any combination thereof. In one or more embodiments, formation or production fluid, such as fluid 116, may comprise a hydrocarbon (such as oil, gas or both), liquid, water, or any combination thereof.

A drive shaft 212 may be disposed or positioned axially within the external housing 202 of the intake section 108. In one or more embodiments, the one or more bearing supports 222 are disposed or positioned circumferentially about a drive shaft 212. The drive shaft 212 may freely rotated within the intake section 108 and may be coupled to a motor of a pump (not shown), for example, pump 106 of FIG. 1. An eccentric intake 204 may be circumferentially positioned or disposed about the drive shaft 212. Eccentric intake 204 may comprise a Ni-Resist cast iron or alloy or any other suitable material. In one or more embodiments, the eccentric intake 204 may be self-orienting. The thickness of eccentric intake 204 may vary such that a first portion or side 224 of the eccentric intake 204 comprises a thickness "A" and a second portion or side 226 of eccentric intake 204 comprises a thickness "B." As thickness "A" is greater than thickness "B", the first portion or side 224 of eccentric intake 204 is heavier than the second portion or side 226 of eccentric intake 204. Gravity may cause the eccentric intake 204 to rotate about the drive shaft 212 or orient within the borehole as the first portion or side 224 of the eccentric intake 204 is heavier due to the thickness "A" than the second portion or side 226 of the eccentric intake 204 which is lighter due to the thickness "B". For example, gravity causes the eccentric intake 204 to rotate about the drive shaft 212 or to automatically orient or self-orient to position the first portion or side 224 (the heavier side) on a bottom side 218 of the intake section 108 and the second portion or side 226 (the lighter side) at a top side 220 of the intake section 108.

Eccentric intake 204 may comprise one or more openings or apertures 208. The one or more apertures or openings 208 may be disposed about, positioned along or otherwise formed in the first portion or side 224 of eccentric intake 204. The one or more apertures or openings 208 allow fluid, for example, fluid 116, that has entered the intake section 108 via the one or more ports 210 to flow through the intake section 108, for example, to pump 106 of FIG. 1. The one or more apertures or openings 208 may be positioned or disposed at any one or more locations at, about, around or along the first portion or side 224 of eccentric intake 204, for example, circumferentially, axially or both. In one or more embodiments, a first set of openings or apertures 208 are aligned along an axis of the eccentric intake 204. In one or more embodiments, a second set of openings or apertures 208 are aligned along an axis of the eccentric intake 204 and circumferentially offset from the first set of openings or apertures 208. The present disclosure contemplates the first portion or side 224 of eccentric intake 204 comprising any number of openings or apertures 208. In one or more embodiments, any one or more opening or apertures 208 may be any size, shape or dimension. The number, size, shape, dimension or any other property of the one or more opening or apertures 208 may be based, at least in part, on any one or more characteristics of a fluid including, but not limited to, the viscosity, density or type of formation or production fluid to be pumped, for example, fluid 116, the type, size, orientation or any other dimension of borehole 102 or any combination thereof. The one or more apertures or openings 208 may be selected, disposed, positioned or any combination thereof to provide metering of the fluid 116 received via the one or more ports 210.

A blocker sleeve 206 may be positioned or disposed about an eccentric intake 204, for example, circumferentially about the eccentric intake 204, such that a fluid pathway 214 is created between the blocker sleeve 206 and the eccentric intake 204. The blocker sleeve 206 may comprise a Ni-Resist cast iron or alloy or any other suitable material. The blocker sleeve 206 may be slidably positioned or disposed within the external housing 202 such that the blocker sleeve 206 may be actuated between each distal end of the intake section 108 to one or more locations along the external housing 202 within the intake section 108. For example, blocker sleeve 206 may be actuated such that the blocker sleeve 206 slides to and from each end or anywhere in between of the intake section 108 to block any one or more ports 210 to prevent the intake of a production or formation fluid through the blocked one or more ports 210 and to expose any one or more other ports 210 to provide fluid communication between the one or more exposed ports 210 and the fluid pathway 214 which is also in fluid communication with the one or more apertures or opening 208. The one or more exposed ports 210 allow the intake of a production or formation fluid through the exposed one or more ports 210, the fluid pathway 214 and the one or more apertures or openings 208 to a pump (not shown). For example, FIG. 2 illustrates the blocker sleeve 206 positioned or disposed such that the left-most port 210A (and all ports 210 along the same plane such as a corresponding port 210 on a top side 220) is exposed and all other ports 210B, 210C, 210D and 210E (and all ports 210 along the same plane such as one or more corresponding ports 210 on a bottom side 218) are blocked. In one or more embodiments, blocker sleeve 206 may block a single port 210 or multiple ports 210. In one or more embodiments, gravity actuates blocker sleeve 206 such that the blocker sleeve 206 slides to any location or position along the intake section 108 to block one or more ports 210 and to expose one or more ports 210.

In one or more embodiments, the intake section 108 self-aligns with respect to the lowest point of the borehole to allow a fluid to flow from a bottom portion or side 218 of the intake section 108 to pump 106 as opposed to a top portion or side 220. For example, the center of gravity of the intake section 108 may be such that the intake section 108 self-aligns to allow fluid from the bottom side 218 of the intake section 108 to pump 106.

Figure 3:
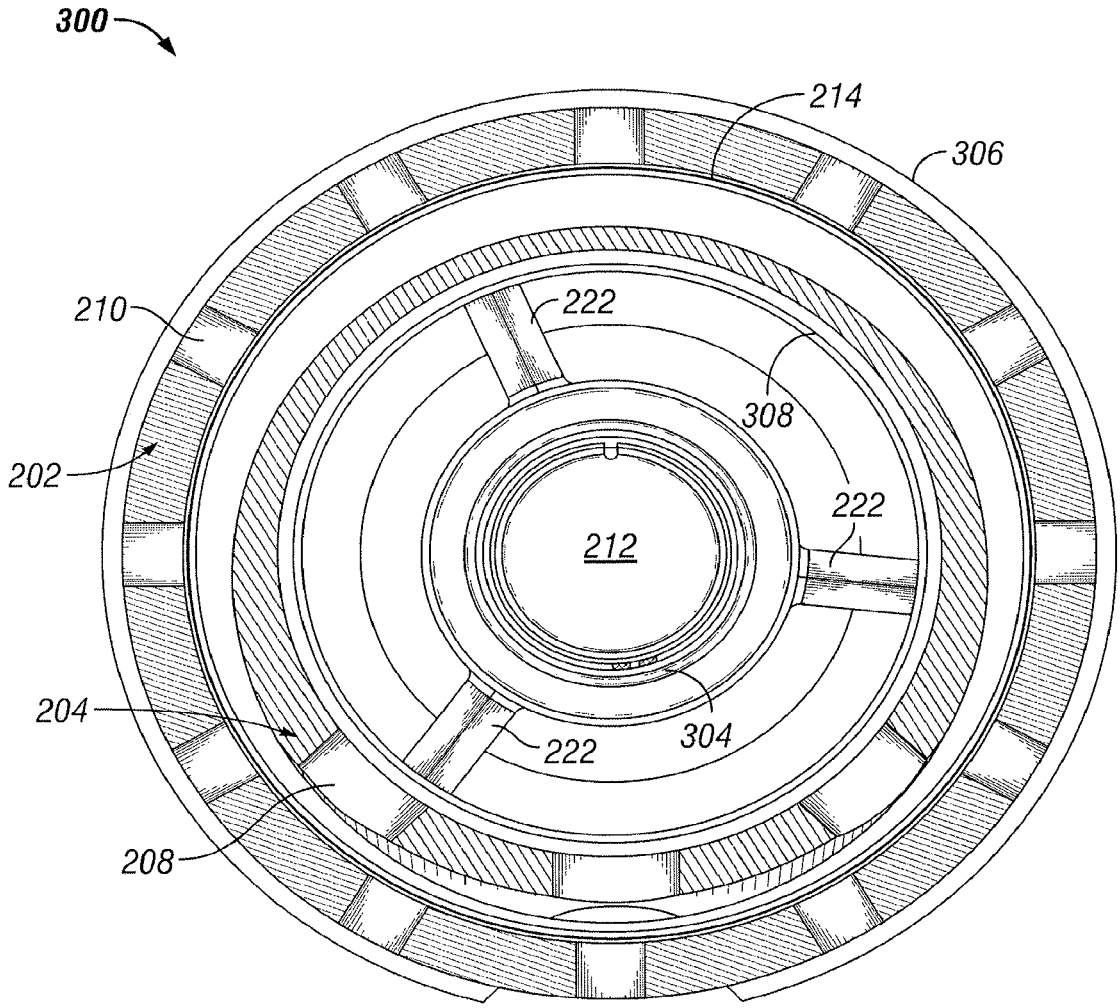
FIG. 3 is a top cross-sectional view of an intake section of a pumping system, according to one or more aspects of the present disclosure.

FIG. 3 is a top cross-sectional view of an intake section 300 of a pumping system, according to one or more aspects of the present disclosure. The illustration in FIG. 3 of the intake section 300 is similar to the intake section 108 from FIG. 2. The intake section 300 may comprise a base flange 306. Base flange 306 allows the intake section 300 to couple to one or more other components or downhole tools. For example, a base flange 306 may couple the intake section 108 to the pump 106 (as illustrated in FIG. 1). External housing 202 may be disposed or positioned between the base flange 306 and a flow path 214. The external housing 202 may comprise one or more ports 210.

An eccentric intake inner housing support 308 may be disposed or positioned within the external housing 202. An eccentric intake 204 may be disposed or positioned between the flow path 214 and the eccentric intake inner housing support 308. The eccentric intake 204 may comprise one or more apertures or openings 208 as discussed above with respect to FIG. 2.

One or more bearing supports 222 may be circumferentially coupled to or disposed or positioned about a drive shaft support or bushing 304. The one or more bearing supports 222 may couple to the eccentric intake inner housing support 308 that is disposed between the eccentric intake 204 and the drive shaft support or bushing 304. The drive shaft support or bushing 304 may be positioned or disposed about at least a portion of a drive shaft 212 such that the at least the portion of the drive shaft 212 rotates within the drive shaft support or bushing 304. The one or more bearing supports 222 centralize the drive shaft support or bushing 304.

Figure 4A:
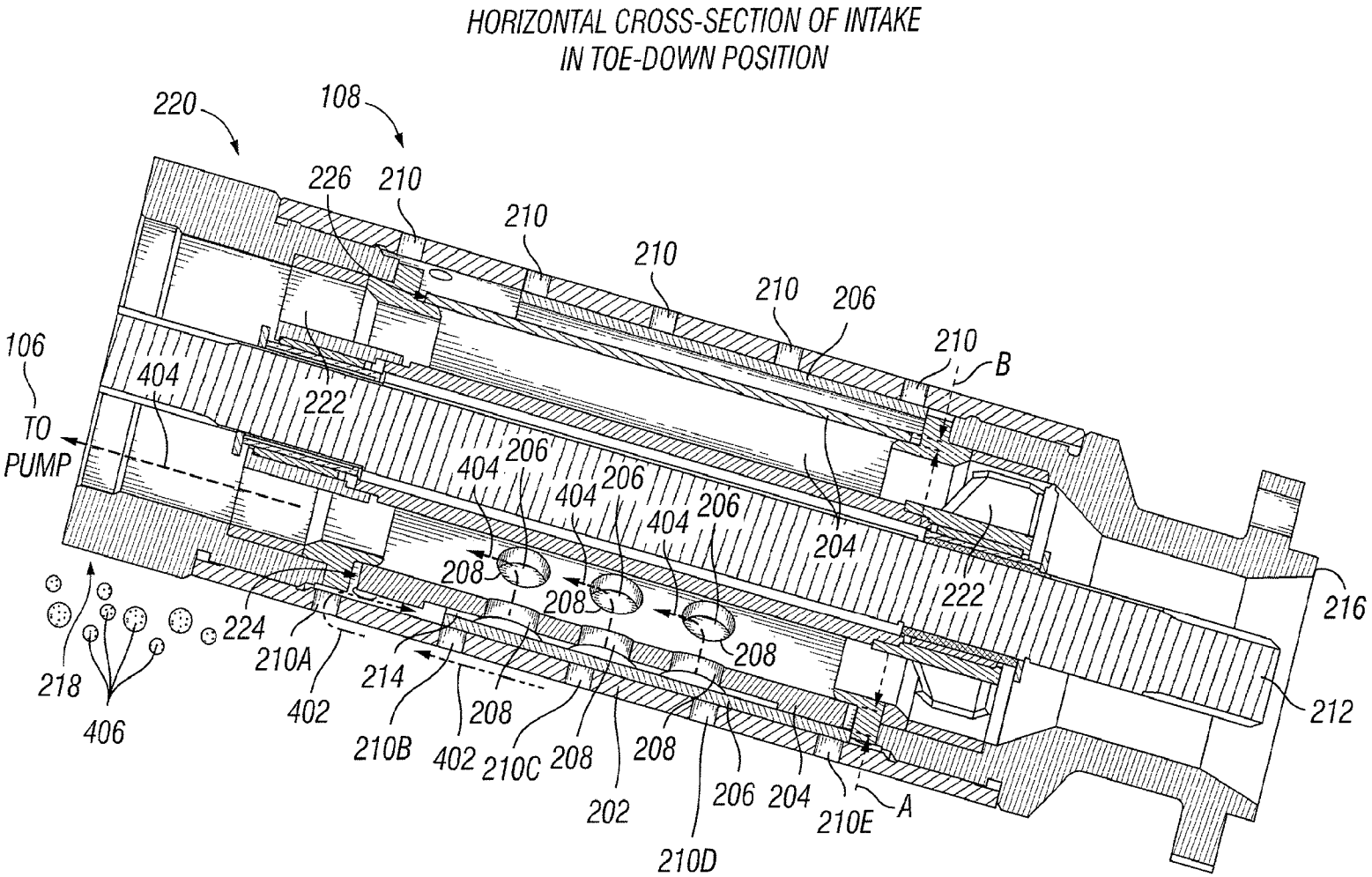
FIG. 4A is a schematic of cross-sectional view of an intake section of a pumping system in a wellbore environment, according to one or more aspects of the present disclosure.

FIG. 4A is a schematic of an intake section 108 of a pumping system in a wellbore environment, according to one or more aspects of the present disclosure. A fluid 402, for example, fluid 116 of FIG. 1, may comprise a liquid component and a gas component. As gas may be detrimental to a pumping system, separating the gas from the liquid may prevent shut-down of an operation, cessation pumping, decrease in production, any other delay or inefficiency in production or any combination thereof. The self-orienting intake section 108 may align or adjust for toe-down positioning within a lateral borehole as illustrated in FIG. 4A. Such alignment facilitates reverse flow gas breakout into the intake section 108. For example, the intake section 108 self-aligns or self-orients such that the blocker sleeve 206 is positioned to expose a port 210, for example, port 210A, while blocking one or more other ports 210, for example, ports 210B, 210C, 210D and 210E. As fluid 402 is drawn up the borehole, a gas component 406 of the fluid 402 naturally ascends the borehole toward a surface as compared to a liquid component 404 of the fluid 402. The liquid component 404 of the fluid 402 is drawn into the exposed port 210A and flows via the flow path 214 through the one or more openings or apertures 208 to a pump 106. The present disclosure contemplates that gas component 406 may comprise any one or more of any type of gas including, but not limited, a vapor, methane, dioxide, nitrogen or any combination thereof. The present disclosure contemplates that liquid component 404 may comprise any one or more of any type of liquid including, but not limited to any type of hydrocarbon (for example, oil), water, mud or any combination thereof. In one or more embodiments, a portion of liquid component 404 may comprise a gas. The gas portion of liquid component 404 may be an amount that is not harmful to or does not cause interference with or cessation of the operation of the pump 106.

Figure 4B:
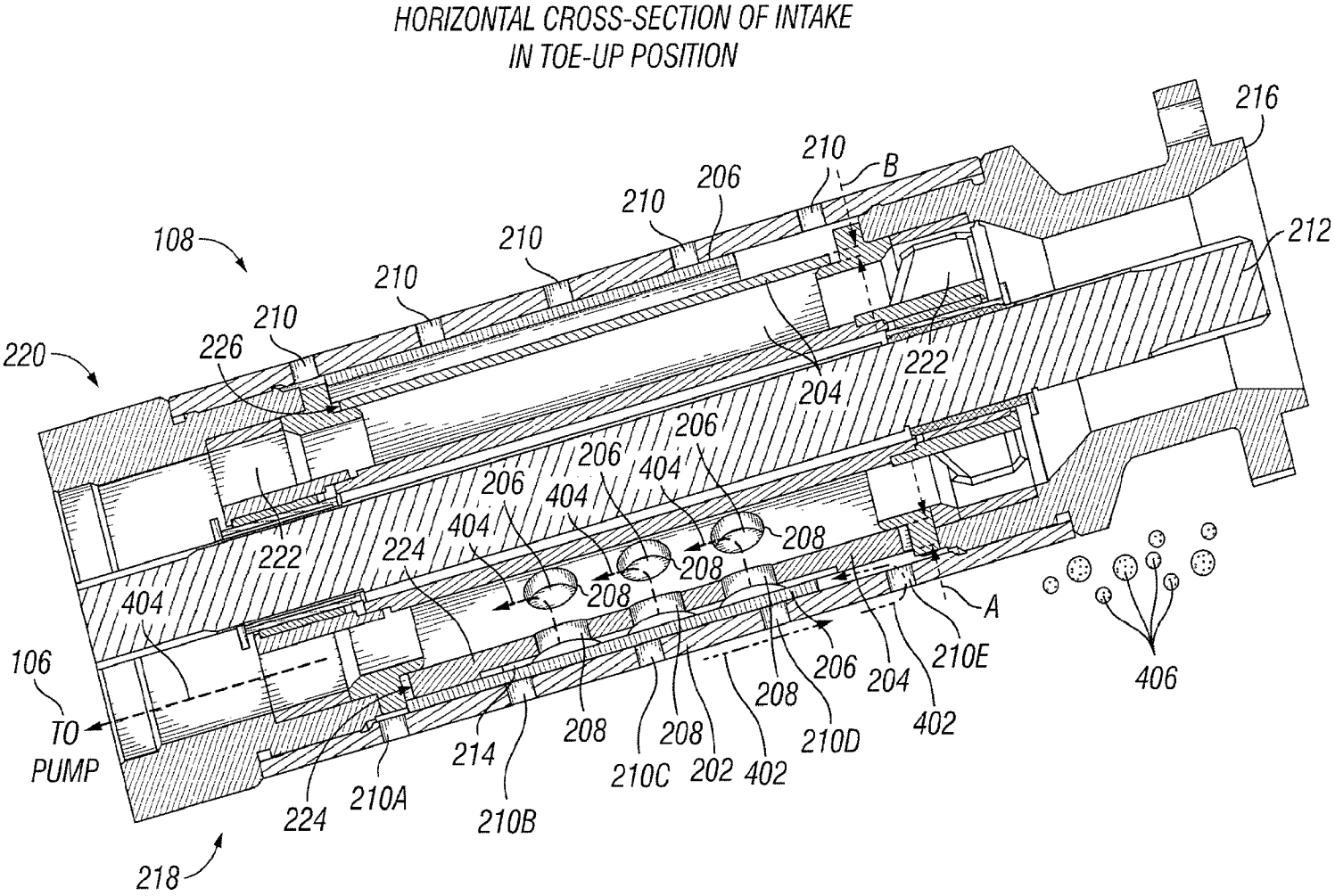
FIG. 4B is a schematic of a cross-sectional view of an intake section of a pumping system in a wellbore environment, according to one or more aspects of the present disclosure.

FIG. 4B is a schematic of an intake section 108 of a pumping system in a wellbore environment, according to one or more aspects of the present disclosure. The self-aligning or self-orienting intake section 108 may align or adjust for toe-up positioning within a lateral borehole as illustrated in FIG. 4B. Such alignment facilitates reverse flow gas breakout into the intake section 108. For example, the intake section 108 self-aligns such that the blocker sleeve 206 is positioned to expose a port 210, for example, port 210E, while blocking one or more other ports 210, for example, ports 210A, 210B, 210C and 210D. As fluid 402 is drawn up the borehole, any gas component 406 of the fluid 402 naturally ascends to a higher position within the borehole as compared to the liquid component 404 of the fluid 402. The liquid component 404 of the fluid 402 is drawn into the exposed port 210E and flows via the flow path 214 through the opening or apertures 208 to a pump 106.

Figure 5:
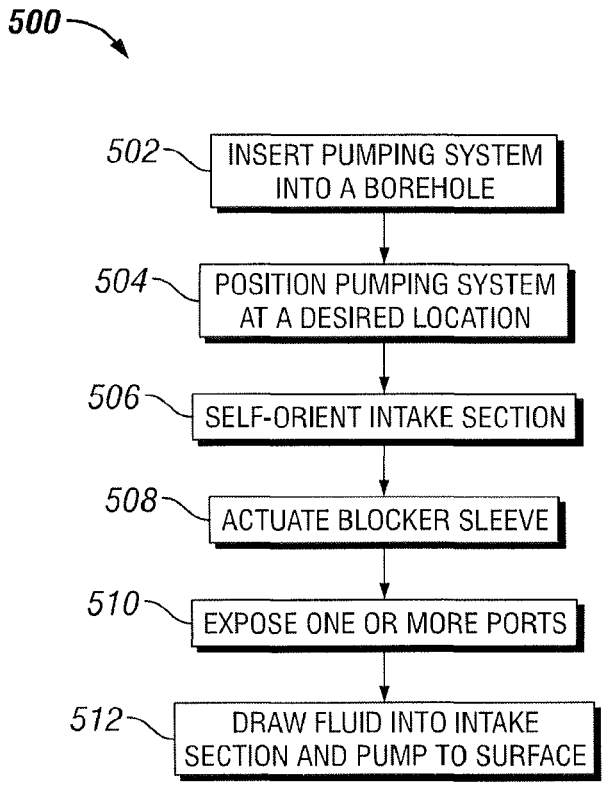
FIG. 5 is a process flow diagram illustrating a method of operating a pumping system for pumping downhole fluid, according to one or more aspects of the present disclosure.

FIG. 5 is a process flow diagram illustrating a method 500 of operating a pumping system 150 of FIG. 1 (such as an electrical submersible pumping system) for pumping a downhole fluid, for example fluid 116 of FIG. 1 or 402 of FIGS. 4A and 4B, according to one or more aspects of the present disclosure. At step 502, a pumping system 150 as illustrated in FIG. 1 is inserted into a borehole 102. In one or more embodiments, the pumping system 150 may be conveyed downhole via a tubing or pipe 104. The pumping system 150 may comprise any one or more components as discussed above with respect to FIGS. 1, 2, 3, 4A and 4B. At step 504, the pumping system 150 is disposed or positioned at a desired location within the borehole 102 or the pumping system 150 reaches any one or more locations within the borehole 102. In one or more embodiments, the pumping system 150 is disposed or positioned at or near a bottom of the borehole 102 or at any location along the borehole 102 proximate to a downhole fluid, such as fluid 116 or fluid 402.

At step 506, the intake section 108 self-orients or self-aligns along the borehole. In one or more embodiments, the intake section 108 rotates or orients at an angle such that one or more ports 210 are aligned with an axis of the borehole 102. Orienting the intake section 108 may comprise aligning or orienting the one or more apertures or ports 208 with one or more ports 210. As the eccentric intake 204 comprises a first portion 224 that is a heavier than a second portion 226, gravity will cause the eccentric intake 204 to self-orient. For example, the eccentric intake 204 automatically or naturally due to gravity rotates about the drive shaft 212 or orients such that the heavier side (the first portion 224) that comprises one or more apertures or openings 208 is aligned along a bottom side 218 of the intake section 108 and the lighter side (the second portion 226) is aligned along a top side 220 of the intake section 108.

At step 508, a blocker sleeve 206 is actuated to slidably position or dispose the blocker sleeve 206 at a location within the intake section 108. At step 510 one or more ports 210 are exposed and one or more other ports 210 are blocked based on the actuation of the blocker sleeve 206. In one or more embodiments, a force, for example, gravity, causes the blocker sleeve 206 to slide to one or more positions within the intake section 108. The slider sleeve 206 is positioned such that the one or more exposed ports are at a portion of the intake section 108 where the gas component, for example, gas component 406 of FIGS. 4A and 4B, of the fluid 116 or fluid 402 has ascended to a higher position within the borehole 102 as compared to the liquid component, for example, liquid component 404, of the fluid 116 or fluid 402.

At step 512, a liquid component 404 of the fluid 116 or fluid 402 is drawn into the intake section 108 via one or more exposed ports 210 as illustrated in FIGS. 4A and 4B. At step 512, the liquid component 404 is drawn into the pump 106. At step 514, the liquid component 404 is pumped to a surface, for example, as a production fluid by a pump 106.

In one or more embodiments, a pumping system comprises a pump, an intake section coupled to the pump, wherein the intake section comprises an external housing, wherein the external housing comprises one or more ports, a self-orienting eccentric intake positioned within the external housing comprising at least a first portion of a first thickness and a second portion of a second thickness, wherein the eccentric intake orients based on the first portion and the second portion, and wherein the first portion comprises one or more openings, a blocker sleeve slidably positioned between the external housing and the eccentric intake, and a flow path between the blocker sleeve and the eccentric intake, a motor section coupled to the intake section and wherein the blocker sleeve blocks at least a first port of the one or more ports and exposes at least a second port of the one or more ports, and wherein the exposed second port is in fluid communication with the flow path and the one or more openings. In one or more embodiments, the pumping system further comprises wherein the electrical submersible pump is suspended in a borehole via a production tubular. In one or more embodiments, the pumping system further comprises wherein the external housing comprises a carbon steel. In one or more embodiments, the pumping system further comprises wherein the eccentric intake comprises a Ni-Resist cast iron or a Ni-Resist alloy. In one or more embodiments, the pumping system further comprises wherein the flow path comprises a groove. In one or more embodiments, the pumping system further comprises wherein the intake section further comprises an eccentric intake inner housing support disposed within the external housing, and wherein the eccentric intake is disposed between the flow path and the eccentric intake inner housing support. In one or more embodiments, the pumping system further comprises a drive shaft and wherein the intake section further comprises a drive shaft, wherein the intake section further comprises a drive shaft support disposed about the drive shaft and one or more bearing supports coupled to the eccentric intake inner housing support and the drive shaft support.

In one or more embodiments, a method of operating an electrical submersible pumping system comprises disposing the electrical submersible pumping system in a borehole, self-orienting an intake section of the electrical submersible pumping system, actuating a blocker sleeve of the intake section of the electrical submersible pumping system, exposing a port of an external housing of the intake section based on the actuation of the blocker sleeve and drawing a fluid from the borehole through the exposed port into the intake section. In one or more embodiments, the method further comprises drawing the fluid from the exposed port into a fluid path between the blocker sleeve and the external housing. In one or more embodiments, the method further comprises drawing the fluid from the fluid path through one or more opening of an eccentric intake, wherein the blocker sleeve is disposed about the eccentric intake. In one or more embodiments, the method further comprises drawing the fluid into a pump coupled to the intake section. In one or more embodiments, the method further comprises wherein self-orienting the intake section comprises aligning the intake section for a toe-down position within the borehole. In one or more embodiments, the method further comprises wherein self-orienting the intake section comprises aligning the intake section for a toe-up position within the borehole.

In one or more embodiments, the gas avoidance system for an electrical submersible pump comprises an external housing, wherein the external housing comprises one or more ports, an eccentric intake positioned within the external housing, wherein the eccentric intake comprises one or more opening, a blocker sleeve slidably positioned between the external housing and the eccentric intake, a flow path between the blocker sleeve and the eccentric intake, a motor section coupled to the intake section, and wherein the blocker sleeve blocks at least a first port of the one or more ports and exposes at least a second port of the one or more ports, and wherein the exposed first port is in fluid communication with the flow path and the one or more exposed ports. In one or more embodiments, the gas avoidance system for the electrical submersible pump further comprises wherein the electrical submersible pump is suspended in a borehole via a production tubular. In one or more embodiments, the gas avoidance system for the electrical submersible pump further comprises wherein the external housing comprises a carbon steel. In one or more embodiments, the gas avoidance system for the electrical submersible pump further comprises wherein the eccentric intake comprises a Ni-Resist case iron or a Ni-Resist alloy. In one or more embodiments, the gas avoidance system for the electrical submersible pump further comprises wherein the flow path comprises a groove. In one or more embodiments, the gas avoidance system for the electrical submersible pump further comprises wherein the intake section further comprises an eccentric intake inner housing support disposed within the external housing, and wherein the eccentric intake is disposed between the flow path and the eccentric intake inner housing support. In one or more embodiments, the gas avoidance system for the electrical submersible pump further comprises a drive shaft, wherein the intake section further comprises a drive shaft support disposed about the drive shaft and one or more bearing supports coupled to the eccentric intake inner housing support and the drive shaft support.

Although the present disclosure and its advantages have been described in detail, it should be understood that various changes, substitutions and alterations can be made herein without departing from the spirit and scope of the disclosure as defined by the following claims.

What is claimed is:

1. A pumping system, comprising:

a pump;

an intake section coupled to the pump, wherein the intake section comprises:

an external housing, wherein the external housing comprises one or more ports;

a self-orienting eccentric intake positioned within the external housing comprising at least a first portion of a first thickness and a second portion of a second thickness, wherein the eccentric intake orients based on the first portion and the second portion, and wherein the first portion comprises one or more openings;

a blocker sleeve slidably positioned between the external housing and the eccentric intake; and a flow path between the blocker sleeve and the eccentric intake;

a motor section coupled to the intake section; and wherein the blocker sleeve blocks at least a first port of the one or more ports and exposes at least a second port of the one or more ports, and wherein the exposed second port is in fluid communication with the flow path and the one or more openings.

2. The pumping system of claim 1, wherein the electrical submersible pump is suspended in a borehole via a production tubular.

3. The pumping system of claim 1, wherein the external housing comprises a carbon steel.

4. The pumping system of claim 1, wherein the eccentric intake comprises a Ni-Resist cast iron or a Ni-Resist alloy.

5. The pumping system of claim 1, wherein the flow path comprises a groove.

6. The pumping system of claim 1, wherein the intake section further comprises an eccentric intake inner housing support disposed within the external housing, and wherein the eccentric intake is disposed between the flow path and the eccentric intake inner housing support.

7. The pumping system of claim 1, further comprising:

a drive shaft; and wherein the intake section further comprises:

a drive shaft support disposed about the drive shaft; and one or more bearing supports coupled to the eccentric intake inner housing support and the drive shaft support.

8. A method of operating an electrical submersible pumping system, comprising:

disposing the electrical submersible pumping system in a borehole;

self-orienting an intake section of the electrical submersible pumping system;

actuating a blocker sleeve of the intake section of the electrical submersible pumping system;

exposing a port of an external housing of the intake section based on the actuation of the blocker sleeve; and drawing a fluid from the borehole through the exposed port into the intake section, comprising drawing the fluid from the exposed port into a fluid path between the blocker sleeve and an eccentric intake.

9. The method of claim 8, further comprising drawing the fluid from the fluid path through one or more openings of the eccentric intake, wherein the blocker sleeve is disposed about the eccentric intake.

10. The method of claim 8, further comprising drawing the fluid into a pump coupled to the intake section.

11. The method of claim 8, wherein self-orienting the intake section comprises aligning the intake section for a toe-down position within the borehole.

12. The method of claim 8, wherein self-orienting the intake section comprises aligning the intake section for a toe-up position within the borehole.

13. A gas avoidance system for an electrical submersible pump, comprising:

an external housing, wherein the external housing comprises one or more ports;

an eccentric intake positioned within the external housing, wherein the eccentric intake comprises one or more openings;

a blocker sleeve slidably positioned between the external housing and the eccentric intake;

a flow path between the blocker sleeve and the eccentric intake;

a motor section coupled to the intake section; and wherein the blocker sleeve blocks at least a first port of the one or more ports and exposes at least a second port of the one or more ports, and wherein the exposed first port is in fluid communication with the flow path and the one or more openings.

14. The gas avoidance system for the electrical submersible pump of claim 13, wherein the electrical submersible pump is suspended in a borehole via a production tubular.

15. The gas avoidance system for the electrical submersible pump of claim 13, wherein the external housing comprises a carbon steel.

16. The gas avoidance system for the electrical submersible pump of claim 13, wherein the eccentric intake comprises a Ni-Resist cast iron or a Ni-Resist alloy.

17. The gas avoidance system for the electrical submersible pump of claim 13, wherein the flow path comprises a groove.

18. The gas avoidance system for the electrical submersible pump of claim 13, wherein the intake section further comprises an eccentric intake inner housing support disposed within the external housing, and wherein the eccentric intake is disposed between the flow path and the eccentric intake inner housing support.

19. The gas avoidance system for the electrical submersible pump of claim 13, further comprising:

a drive shaft; and wherein the intake section further comprises:

a drive shaft support disposed about the drive shaft; and one or more bearing supports coupled to the eccentric intake inner housing support and the drive shaft support.

* * * * *